US009244426B2

(12) United States Patent
Onodera et al.

(10) Patent No.: US 9,244,426 B2
(45) Date of Patent: Jan. 26, 2016

(54) IMAGE FORMING APPARATUS

(71) Applicant: CANON KABUSHIKI KAISHA, Tokyo (JP)

(72) Inventors: Shinichi Onodera, Tokyo (JP); Toshiya Uchibe, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 207 days.

(21) Appl. No.: 13/772,580

(22) Filed: Feb. 21, 2013

(65) Prior Publication Data

US 2013/0223879 A1 Aug. 29, 2013

(30) Foreign Application Priority Data

Feb. 29, 2012 (JP) ..... 2012-044513

(51) Int. Cl.
*G03G 21/16* (2006.01)

(52) U.S. Cl.
CPC ..... *G03G 21/168* (2013.01); *G03G 21/1647* (2013.01)

(58) Field of Classification Search
CPC ..... G03G 21/168
USPC ..... 399/317
See application file for complete search history.

(56) References Cited

U.S. PATENT DOCUMENTS

| | | | | |
|---|---|---|---|---|
| 6,115,568 | A | 9/2000 | Sameshima | |
| 7,469,897 | B2 * | 12/2008 | Hiramoto et al. | 271/314 |
| 7,657,204 | B2 | 2/2010 | Yang | |
| 8,238,790 | B2 | 8/2012 | Furuya et al. | |
| 8,311,448 | B2 | 11/2012 | Hashimoto | |
| 2008/0145122 | A1 | 6/2008 | Kaneko et al. | |
| 2009/0110436 | A1 | 4/2009 | Sugiyama | |
| 2011/0091243 | A1 * | 4/2011 | Tomino et al. | 399/123 |
| 2011/0211871 | A1 | 9/2011 | Mori | |

FOREIGN PATENT DOCUMENTS

| | | | |
|---|---|---|---|
| CN | 101231492 | A | 7/2008 |
| CN | 101713941 | A | 5/2010 |

(Continued)

OTHER PUBLICATIONS

Chinese Office Action dated Apr. 29, 2015, in related Chinese Patent Application No. 201310062481 (with English translation).

(Continued)

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

An image forming apparatus includes an image bearing member forming a toner image, a belt member transferring the toner image, a cam transiting the belt member and the image bearing member between a contact state and a spaced state, and an operating lever for moving the belt member and the image bearing member between the contact state and the spaced state. In addition, a first member has a first engaging portion that moves in interrelation with movement of the cam and transmits a driving force of moving the operating lever to the cam, and a second member has a second engaging portion which engages with the first engaging portion and slidably movable to the first engaging portion. A third member regulates movement of the cam by abutting the second member when the operating lever is moved.

7 Claims, 14 Drawing Sheets

(56) References Cited

FOREIGN PATENT DOCUMENTS

| | | | |
|---|---|---|---|
| CN | 102004430 | A | 4/2011 |
| JP | 8-123215 | A | 5/1996 |
| JP | 10-301464 | A | 11/1998 |
| JP | H10-293437 | A | 11/1998 |
| JP | 2005-43594 | A | 2/2005 |
| JP | 2007-241309 | A | 9/2007 |
| JP | 2008-152112 | A | 7/2008 |
| JP | 2009-080477 | A | 4/2009 |
| JP | 2011-180370 | A | 9/2011 |

OTHER PUBLICATIONS

Japanese Office Action dated Dec. 1, 2015, in related Japanese Patent Application No. 2012-044513.

* cited by examiner (a)

(b)

(a)

(b)

(a)

(b)

IMAGE FORMING APPARATUS

FIELD OF THE INVENTION AND RELATED ART

In an image forming apparatus, such as a copying machine or a printer, to which electrophotography is applied, as a form of a transfer means, a transfer device of a belt transfer type in which a toner image on an image bearing member is transferred onto a sheet while attracting and conveying the sheet by a transfer belt which is a belt member has been used. The image forming apparatus including the transfer device of the belt transfer type includes a transfer belt moving mechanism, using a motor, a solenoid or the like as a driving source, for moving the transfer belt toward and away from the image bearing member with desired timing such as an image forming operation or during jam occurrence.

On the other hand, in order to facilitate jam clearance or a maintenance operation, an image forming apparatus including a conveying unit, on which a transfer device, a fixing device and the like which are provided in a conveying path are mounted, capable of being pulled out from an apparatus main assembly has been widely known. In the image forming apparatus in which the transfer device of the belt transfer type is mounted on the conveying unit capable of being pulled out from the apparatus main assembly, in order to prevent mutual friction between the image bearing member and the transfer device, there is a need to effect mounting and demounting of the conveying unit after the transfer belt is retracted from the image bearing member with reliability.

However, the transfer belt cannot be reliably retracted from the image bearing member in some cases including the case where supply of energy to the motor, the solenoid or the like as the driving source for the transfer belt moving mechanism is blocked and the case where the driving source caused an abnormal operation.

Therefore, in Japanese Laid-Open Patent Application (JP-A) 2011-180370, an image forming apparatus including a transfer belt moving mechanism capable of retracting a transfer belt from a photosensitive drum during mounting and demounting of a conveying unit irrespective of an energy supply state has been proposed. In this image forming apparatus, the transfer belt held by a transfer unit can be retracted from the photosensitive drum by rotating an urging cam for raising and lowering the transfer unit in interrelation with a releasing operation of a handle (operating portion) for releasing a lock mechanism for the conveying unit.

In the case of the image forming apparatus described in JP-A 2011-180370, rotation (rotational movement) motion of a lock-releasing handle for the conveying unit is converted into rotation motion of integrally rotatable urging cam and gear having partly omitted teeth via linear motion of a slidable member including a rack portion. Accordingly, a rotation speed and kinetic energy of the urging cam and the gear having partly omitted teeth which are rotated in interrelation with the releasing operation of the handle depend on a condition such as an operating speed or an operating force during the operation of the handle.

For that reason, e.g., in the case where an abrupt handle operation is performed, the urging cam and the gear having partly omitted teeth which are rotated quickly and increased in inertia cannot stop at a stop position which is a position where the transfer unit is lowered, thus overrunning the stop position. When the urging cam overruns the stop position, the transfer unit is raised again, so that there is a possibility that the transfer and the photosensitive drum are contacted to each other again during the mounting and demounting of the conveying unit.

SUMMARY OF THE INVENTION

The present invention has been accomplished in view of the above-described circumferences. A principal object of the present invention is to provide an image forming apparatus including a structure capable of preventing re-contact of a belt member with an image bearing member caused by overrun of a gear when an operating portion is operated so as to space the belt member from the image bearing member.

According to an aspect of the present invention, there is provide an image forming apparatus comprising: an image bearing member; a belt member provided movably toward and away from the image bearing member; an operating lever movable between a first position where the belt member and the image bearing member are in a contact state and a third position where the belt member and the image bearing member are in a spaced state, wherein between the first position and the third position, a second position where the belt member and the image bearing member are switched between the contact state and the spaced state is located; a cam for transiting the belt member and the image bearing member between the contact state and the spaced state by transmitting thereto a driving force for moving the operating lever to rotate the cam; a transmitting mechanism for transmitting the driving force for moving the operating lever, wherein when the operating lever is moved between the first position and the third position, the transmitting mechanism transmits the driving force to the cam during passing of the operating lever between the first position and the second position and eliminates transmission of the driving force to the cam during passing of the operating lever between the second position and the third position; and a rotation stopping mechanism for stopping, when the operating lever is moved from the first position to the third position, rotation of the cam to maintain the spaced state so that the belt member and the image bearing member are prevented from being transited from the spaced state to the contact state by continuation of the rotation of the cam by inertia.

According to the present invention, the rotation stopping mechanism for stopping the rotation of the gear is provided and therefore when the operating portion is operated so as to space the belt member from the image bearing member, it is possible to prevent the re-contact of the belt member with the image bearing member caused by the overrun of the gear.

These and other objects, features and advantages of the present invention will become more apparent upon a consideration of the following description of the preferred embodiments of the present invention taken in conjunction with the accompanying drawings.

Figure 6:
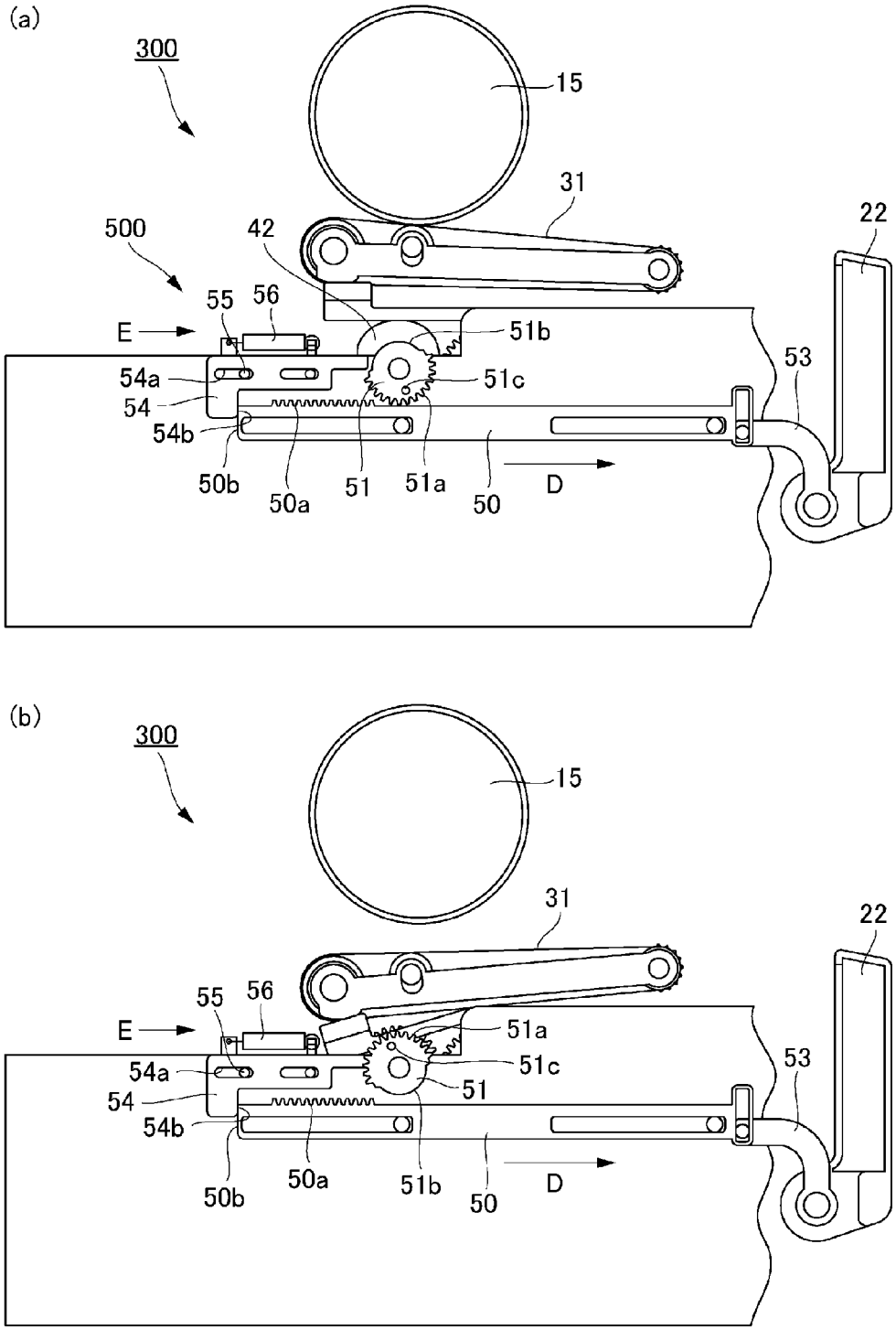

Part (a) of FIG. 6 is a schematic illustration showing a state in which a belt member is contacted to the photosensitive drum in the First Embodiment, and (b) of FIG. 6 is a schematic illustration showing a state in which the belt member is spaced from the photosensitive drum in the First Embodiment.

Figure 7:
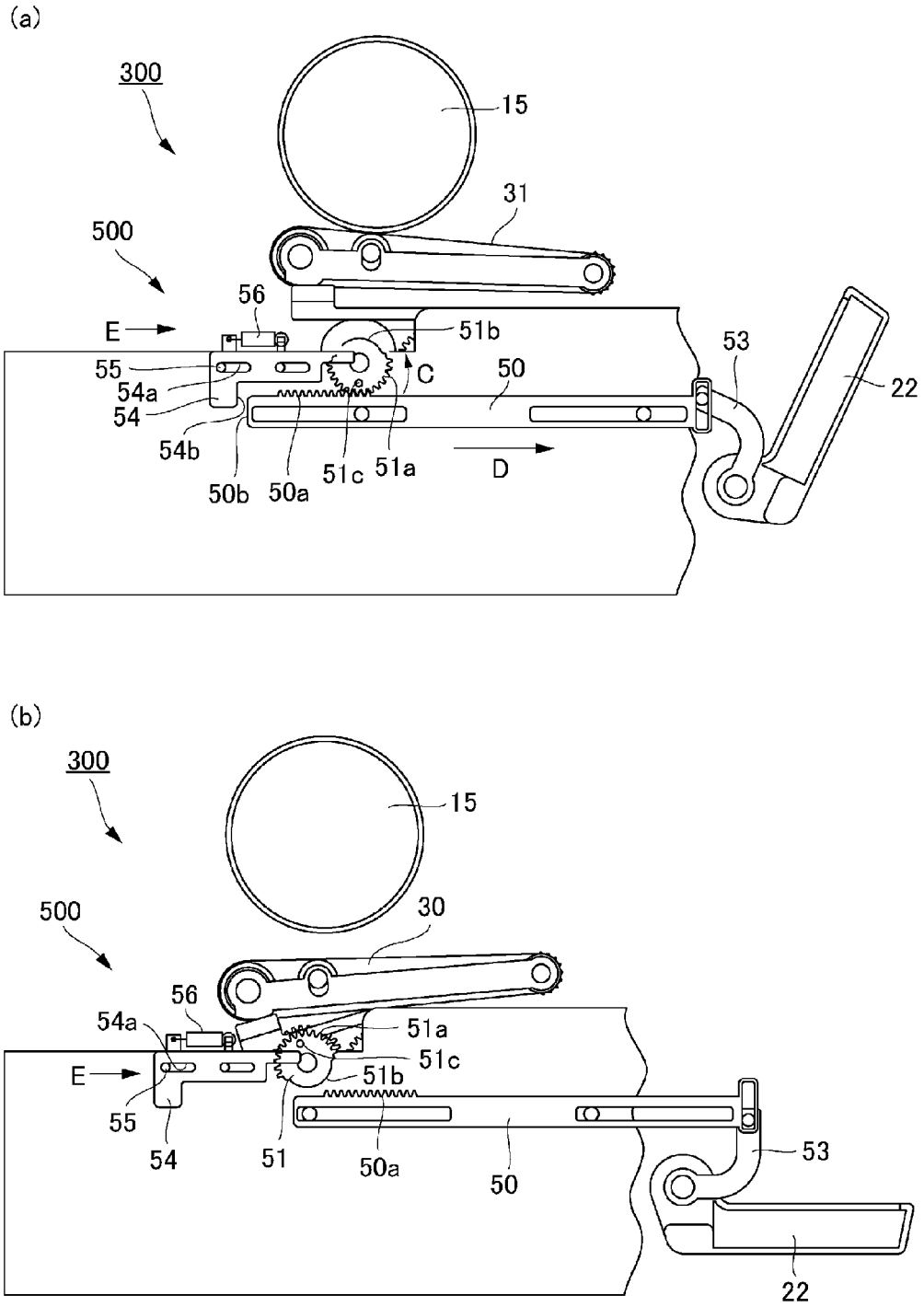

Part (a) of FIG. 7 is a schematic illustration showing a state in which a gear having partly omitted teeth is driven by an operating portion in the First Embodiment, and (b) of FIG. 7 is a schematic illustration showing a state in which rotation of the gear having partly omitted teeth is stopped in the First Embodiment.

Figure 8:
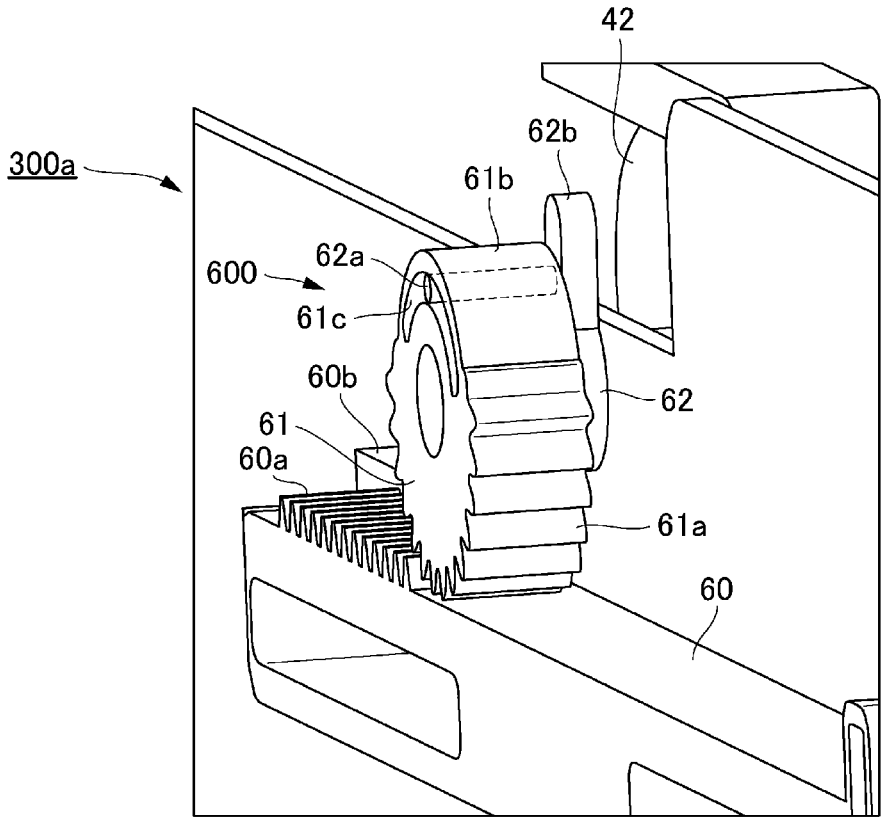

FIG. 8 is a schematic perspective illustration for illustrating a structure for operating a contact and separation mechanism for a belt unit by a handle operation according to a Second Embodiment of the present invention.

Figure 9:
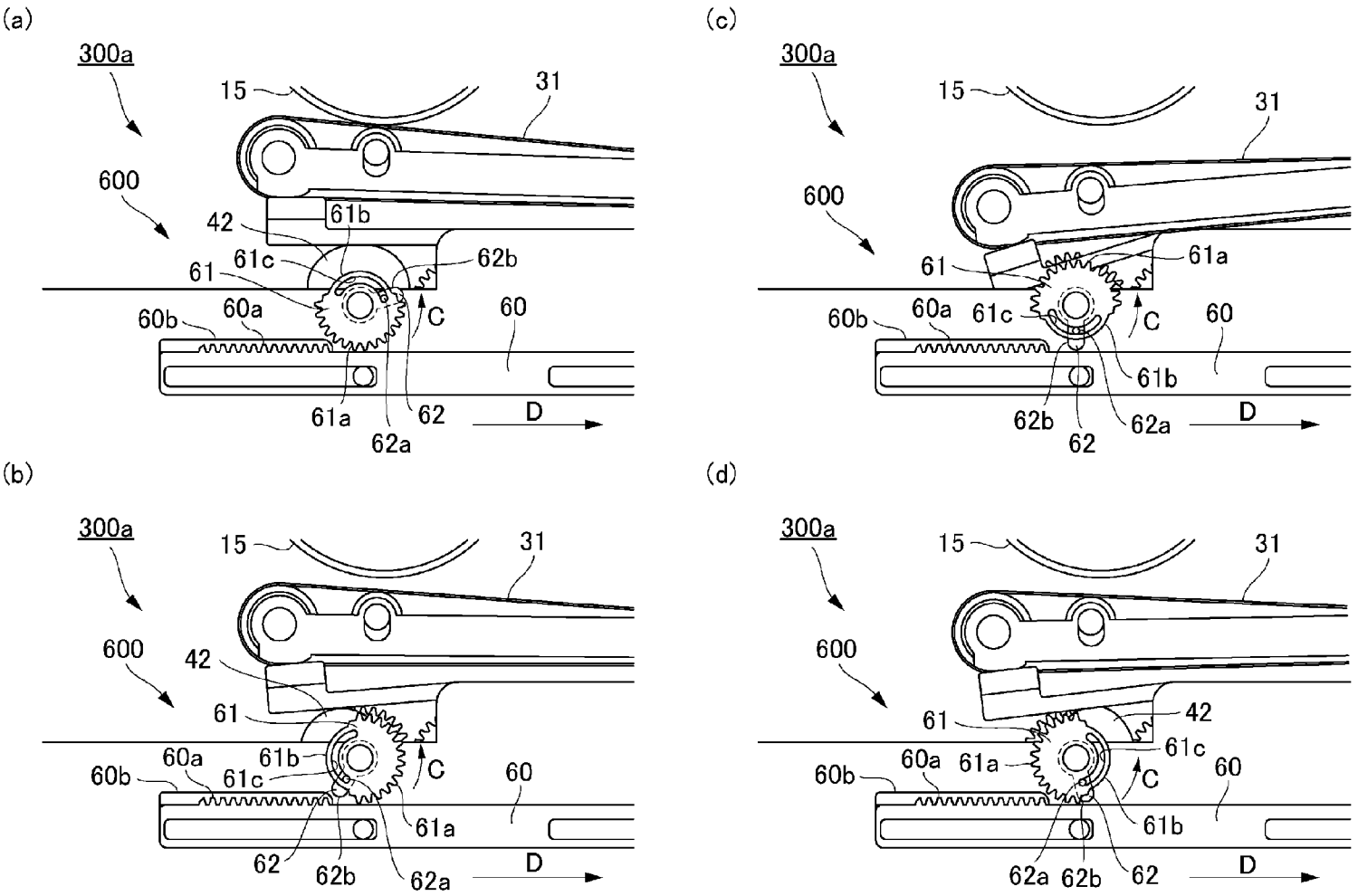

Parts (a) to (d) of FIG. 9 are schematic illustrations sequentially showing an operation for contacting and separating a belt member and a photosensitive drum in the Second Embodiment.

Figure 10:
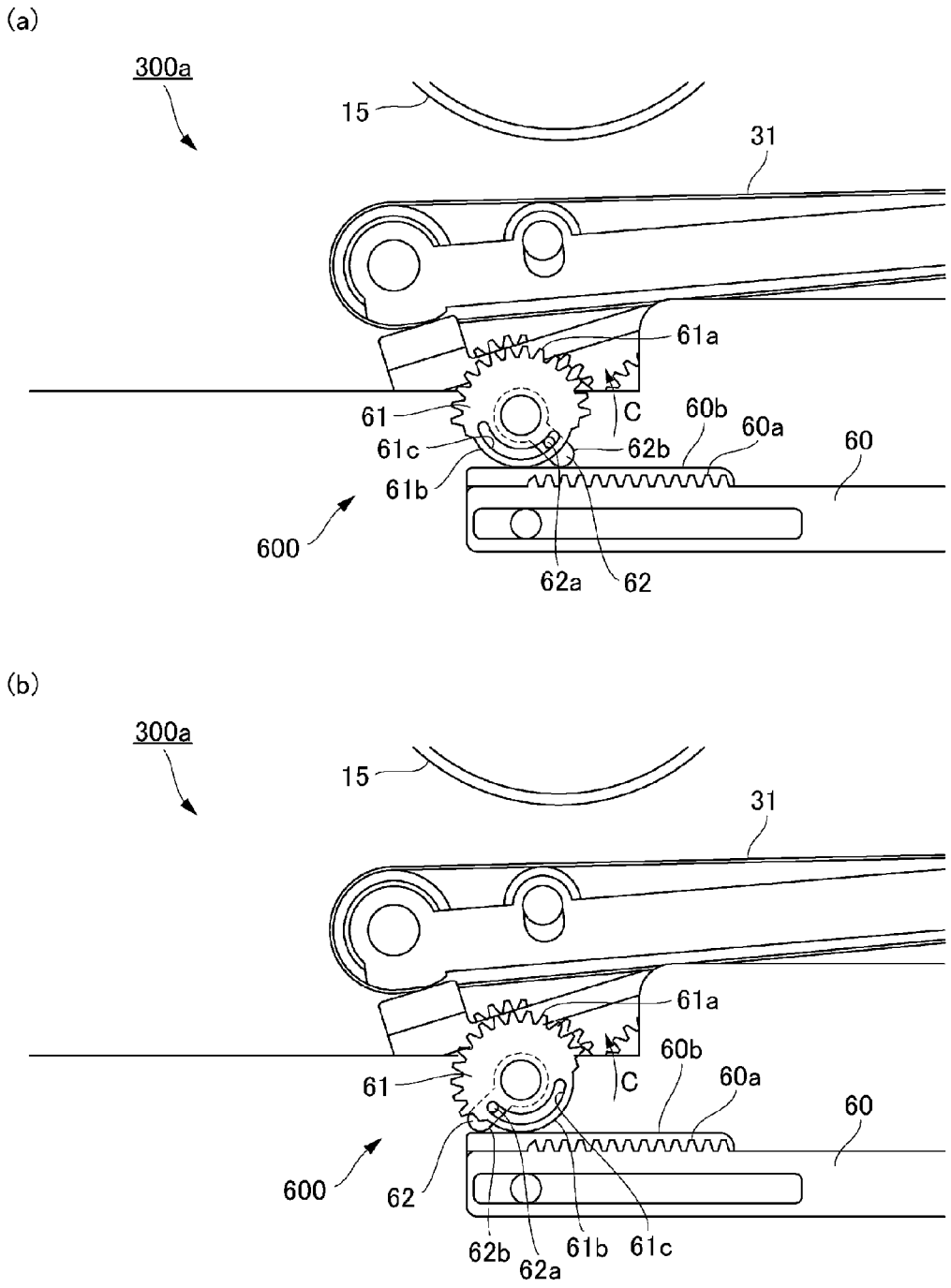

Parts (a) and (b) of FIG. 10 are schematic illustrations sequentially showing motions of respective portions in the case where the contact and separation mechanism for the belt unit is operated by the handle operation in the Second Embodiment.

Figure 11:
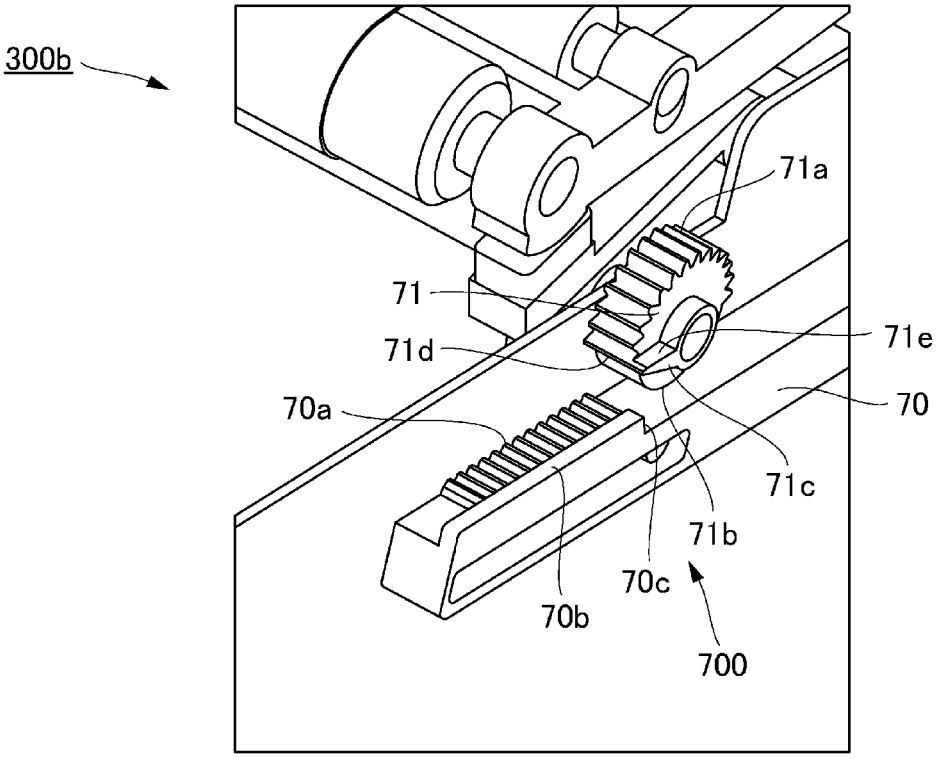

FIG. 11 is a schematic perspective illustration for illustration of a structure for operating a contact and separation mechanism for a belt unit by a handle operation according to a Third Embodiment of the present invention.

Figure 12:
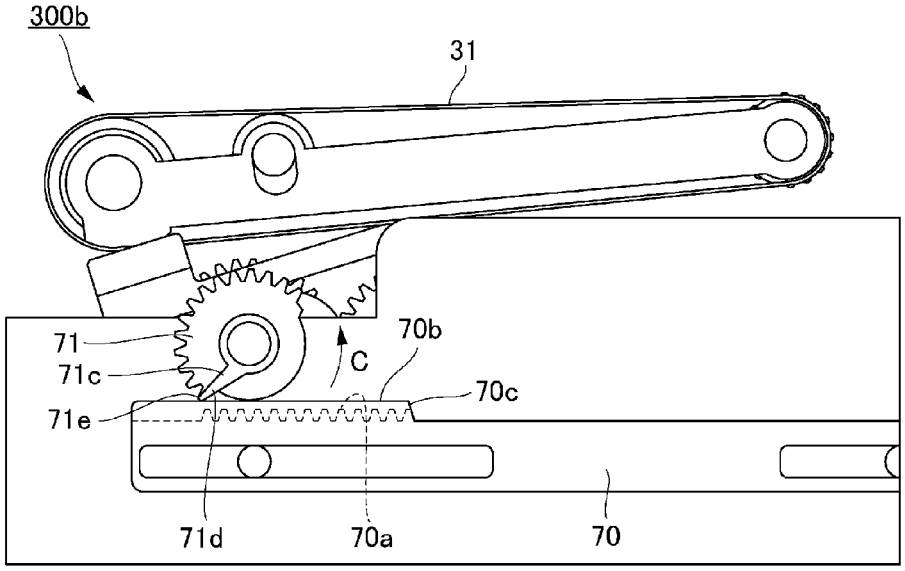
Figure 12:
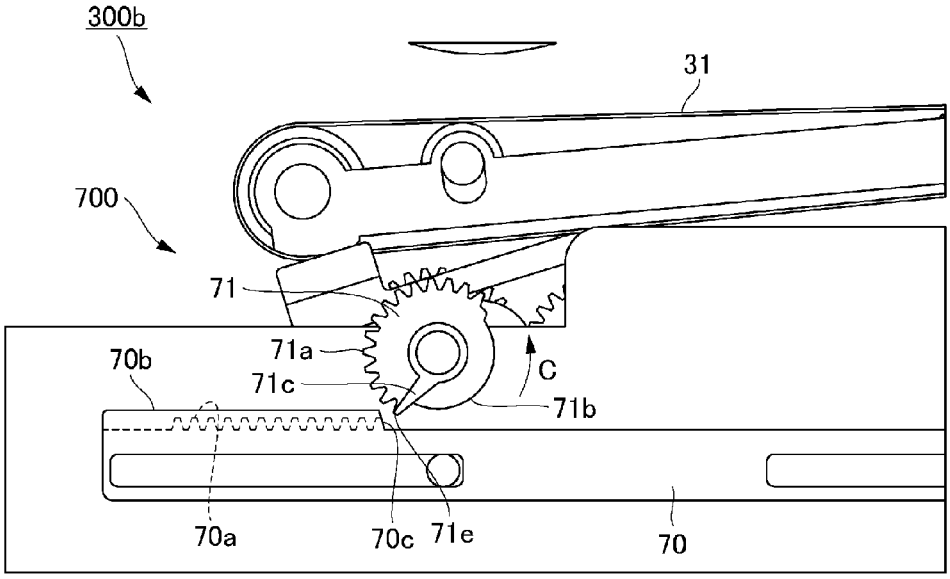

Parts (a) and (b) of FIG. 12 are schematic illustrations showing a state in which rotation of a gear having partly omitted teeth is stopped and a state in which the rotation of the gear having partly omitted teeth is not stopped, respectively, in the Third Embodiment.

Figure 13:
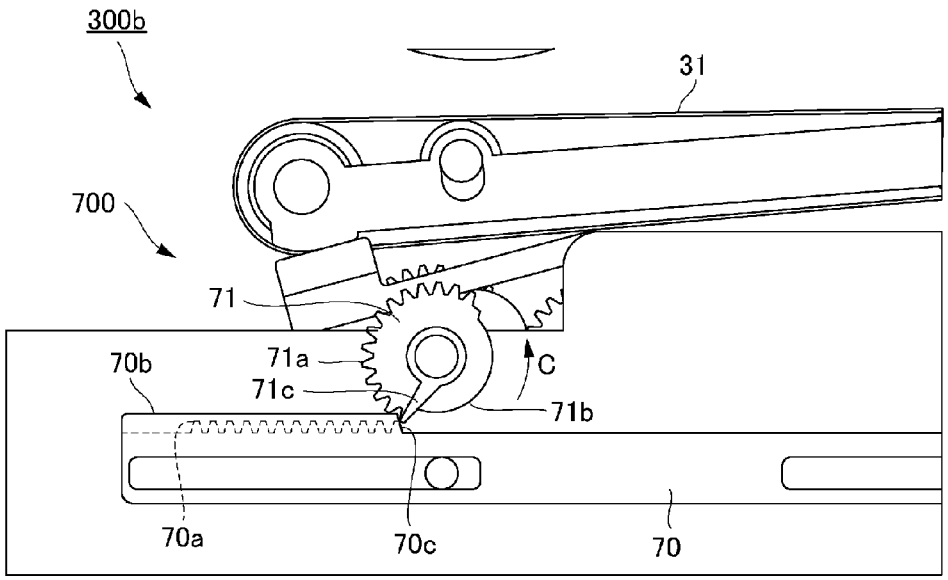
Figure 13:
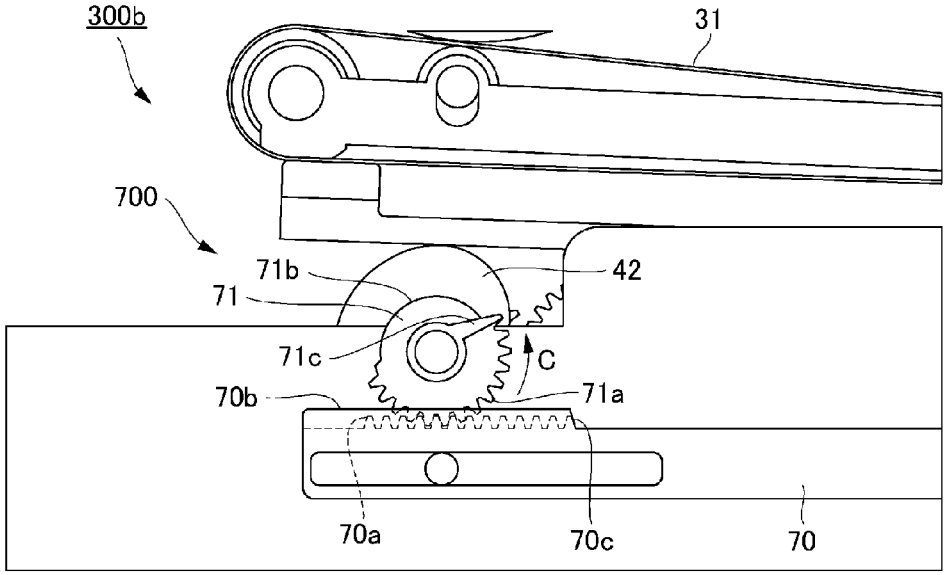

Parts (a) and (b) of FIG. 13 are schematic illustrations sequentially showing motions of respective portions in the case where the contact and separation mechanism for the belt unit is operated by the handle operation in the Third Embodiment.

Figure 14:
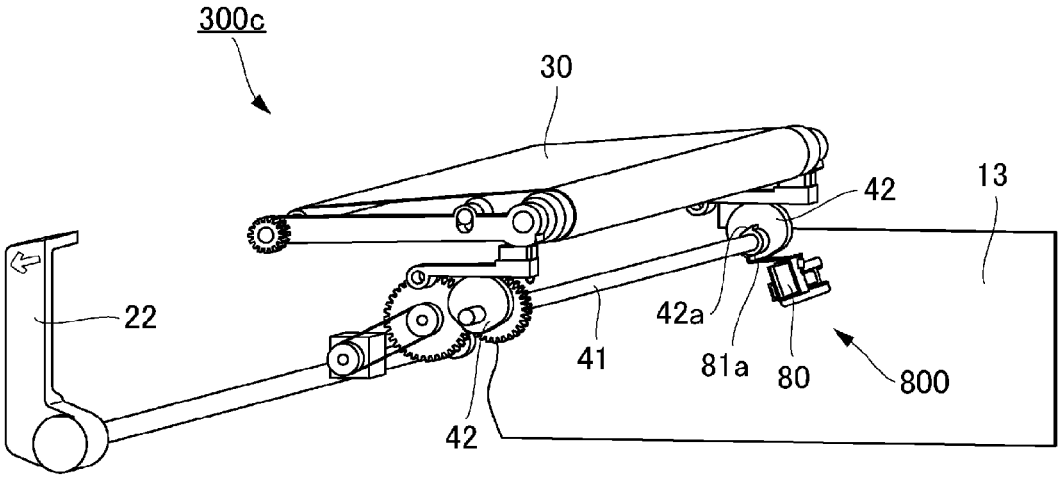

FIG. 14 is a schematic perspective illustration for illustrating a structure for operating a contact and separation mechanism for a belt unit by a handle operation according to a Fourth Embodiment of the present invention.

Figure 15:
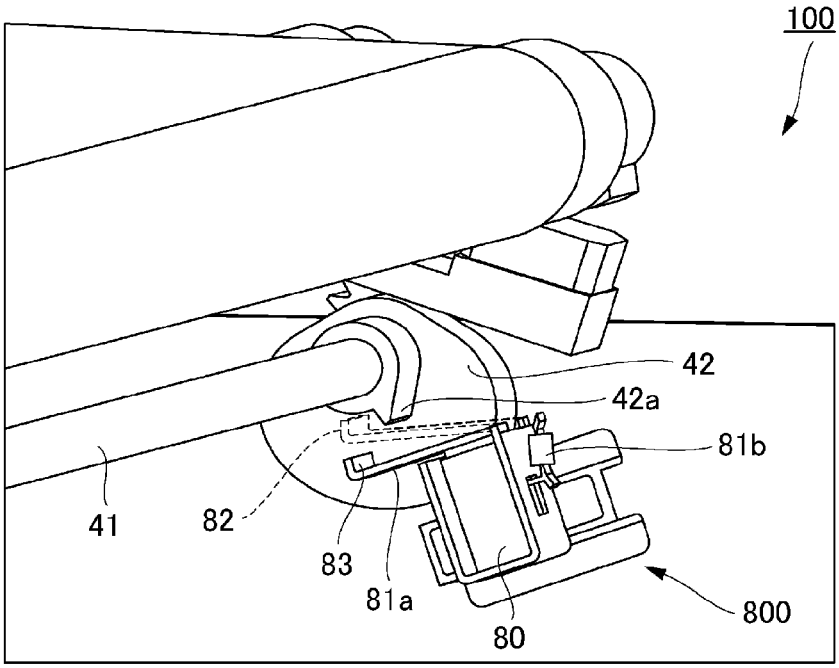
Figure 15:
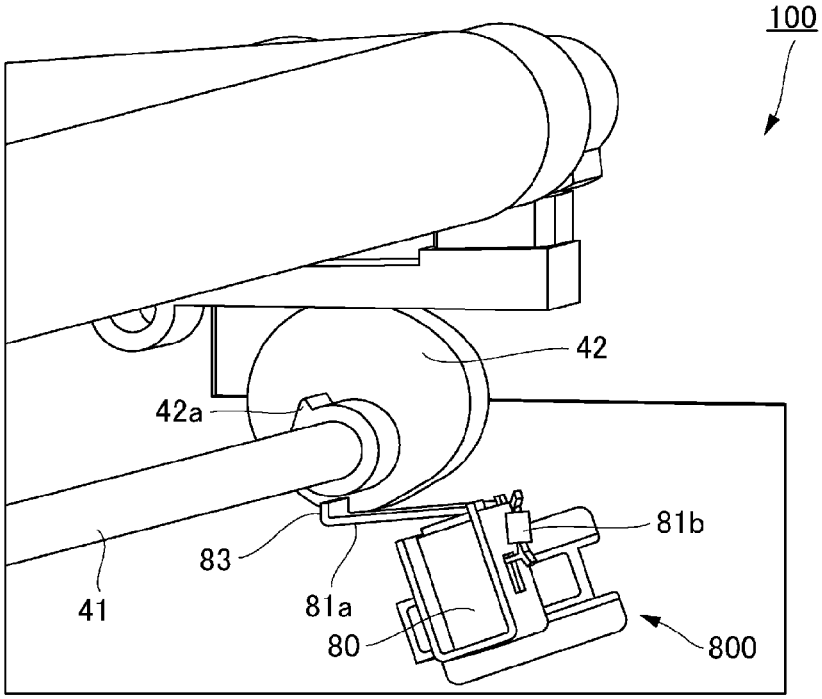

Parts (a) and (b) of FIG. 15 are schematic illustrations showing a state in which rotation of a gear having partly omitted teeth is stopped and a state in which the rotation of the gear having partly omitted teeth is not stopped, respectively, in the Fourth Embodiment.

Figure 16:
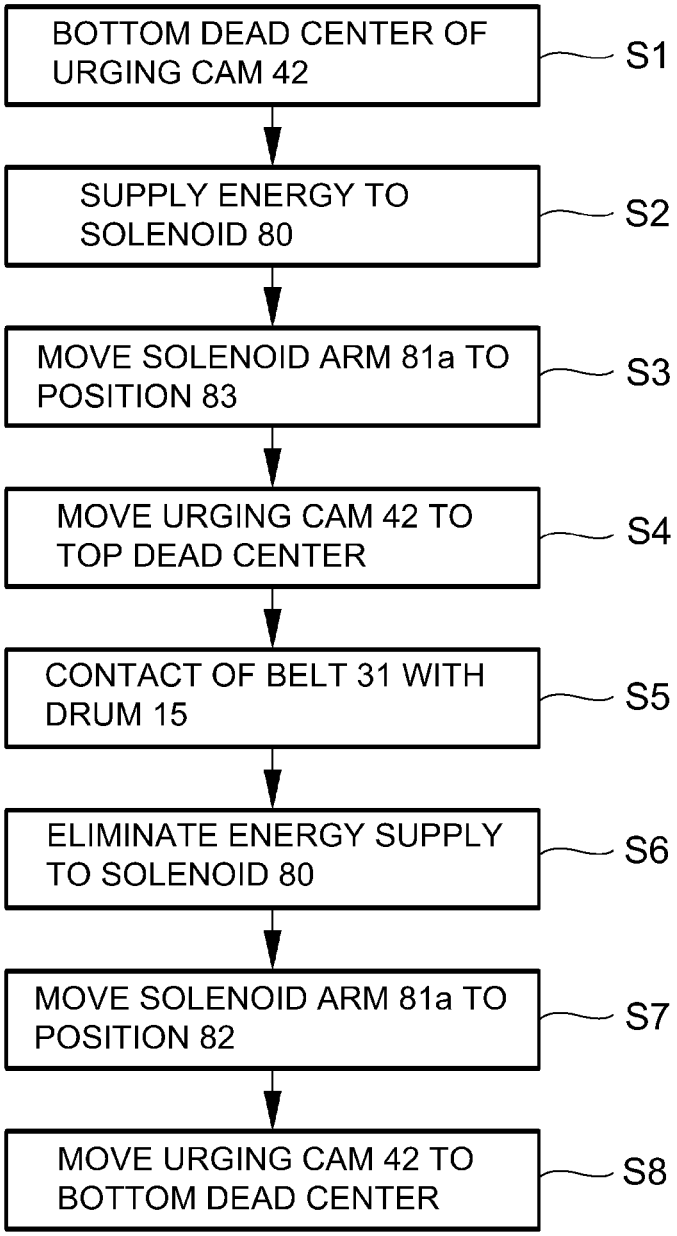

FIG. 16 is a flow chart showing a flow of one rotation operation of the gear having partly omitted teeth in the Fourth Embodiment.

DESCRIPTION OF THE PREFERRED EMBODIMENTS

First Embodiment

First Embodiment of the present invention will be described with reference to FIG. 1 to FIG. 7. First, a general structure of an image forming apparatus including a belt unit in this embodiment will be described with reference to FIGS. 1 and 2.

[Image Forming Apparatus]

Figure 1:
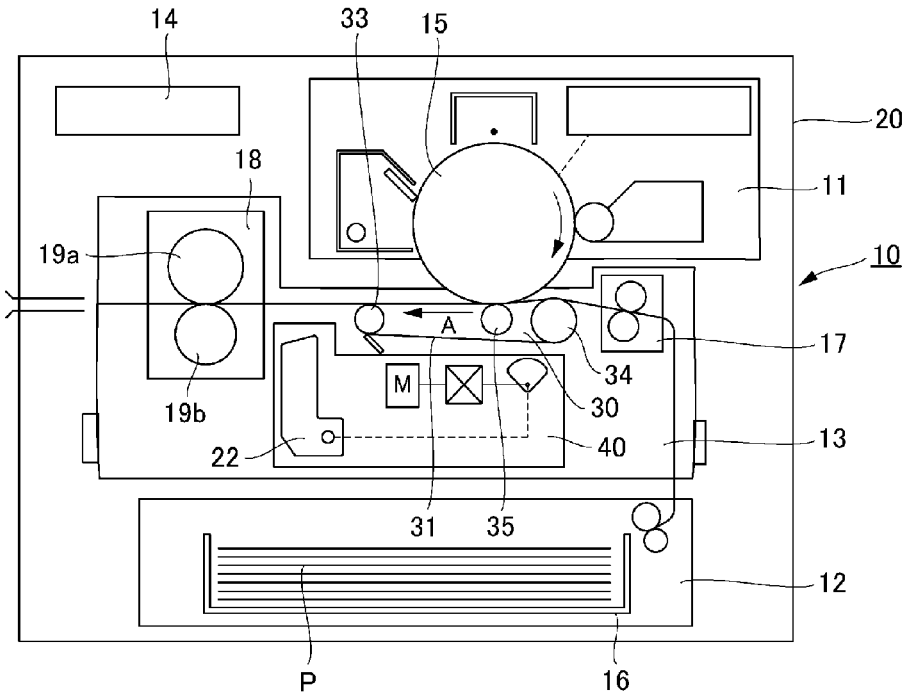
FIG. 1 is a schematic illustration of an image forming apparatus according to a First Embodiment of the present invention.

As shown in FIG. 1, a digital printer 10 as the image forming apparatus of an electrophotographic type includes an image forming portion 11, a sheet feeding portion 12, a conveying unit as a belt unit, and a controller (control portion) 14.

At the image forming portion 11, toner image formation which starts from lower exposure depending on an image signal and which uses an electrophotographic process is effected on a photosensitive drum (photosensitive member) 15 as an image bearing member provided inside an apparatus main assembly. The sheet feeding portion feeds a recording material P, stacked in a sheet cassette 16, toward the conveying unit 13. The conveying unit 13 including a registration device 17, a transfer unit 30 and a fixing device 18 and discharges the recording material P after an image is transferred and fixed on the recording material P fed from the sheet feeding portion 12.

The registration device 17 sends the recording material to the transfer unit 30 in synchronism with the toner image on the photosensitive drum 15. The transfer unit 30 attracts and conveys the recording material P on a transfer belt 31, as a belt member, which is stretched by a driving roller 33 and a stretching roller 34 and which is moved in an arrow A direction in FIG. 1. The transfer belt 31 is urged together with the recording material P toward the photosensitive drum 15 by a transfer roller 35 urged by an urging means (not shown), thus forming a transfer nip between itself and the photosensitive drum 15.

Further, to the transfer roller 35, a voltage of an opposite polarity to that of the toner image formed on the photosensitive drum 15, so that the toner image is transferred at the transfer nip onto the recording material P attracted and conveyed on the transfer belt 31. The recording material P on which the toner image is transferred is delivered from the transfer unit 30 to the fixing device 18, and then the fixing device 18 fixes the toner image on the recording material P by heat and pressure of a pair of fixing rollers 19*a* and 19*b*.

The controller 14 controls operations of respective portions of the digital printer 10 in order to form the image on the recording material P as described above.

The conveying unit 13 at least enables the transfer belt 31 as the belt member to be pulled out from an apparatus main assembly 20. In an example shown in FIG. 2, the transfer unit 13 is supported mountable into demountable from the apparatus main assembly 20 via slide rails 21*a* and 21*b* with respect to a pulling-out direction.

Figure 2:
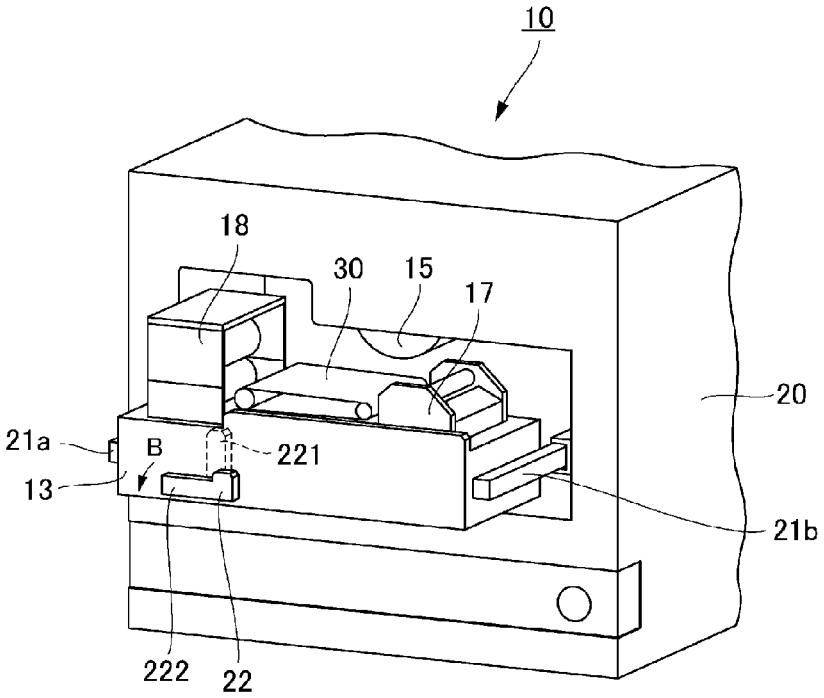
FIG. 2 is a schematic perspective illustration showing a state in which a conveying unit is pulled out from an apparatus main assembly in the First Embodiment.

Further, the conveying unit 13 includes a locking mechanism (not shown), for the conveying unit 13, which operates in interrelation with a rotation (movement) operation of a locking handle 22 which is rotatably supported operating portion. As shown in FIG. 2, the locking mechanism fixes the conveying unit 13 to the apparatus main assembly 20 at a locking position 221 of the locking handle 22 and releases (eliminates) the fixing of the conveying unit 13 to the apparatus main assembly 20 at a releasing position 222 of the locking handle 22.

Accordingly, when the conveying unit 13 is pulled out from the apparatus main assembly 20, the locking handle 22 located at the locking position 221 is rotated in an arrow B direction in FIG. 2 to be moved to the releasing position 222, so that the fixing of the conveying unit 13 is released to enable the pulling-out of the conveying unit 13. On the other hand, after the conveying unit 13 is inserted into the apparatus main assembly 20 until a mounting position, the locking handle 22 located at the releasing position 222 is rotated in a direction opposite from the arrow B direction to be moved to the locking position 221, so that the conveying unit 13 can be fixed to the apparatus main assembly 20.

Further, the conveying unit 13 includes a transfer belt moving mechanism 40 for performing an operation in which the transfer belt 31 is contacted to or retracted from the photosensitive drum 15 (contact or separation operation). In other words, the transfer belt 31 is disposed movably toward and away from the photosensitive drum 15 by the transfer belt moving mechanism 40. The transfer belt moving mechanism 40 performs a contact and retraction spacing operation of the transfer belt 31 depending on the image forming operation and performs a retraction operation of the transfer belt 31 in interrelation with the releasing operation of the locking handle 22.

[Transfer Belt Moving Mechanism]

Figure 3:
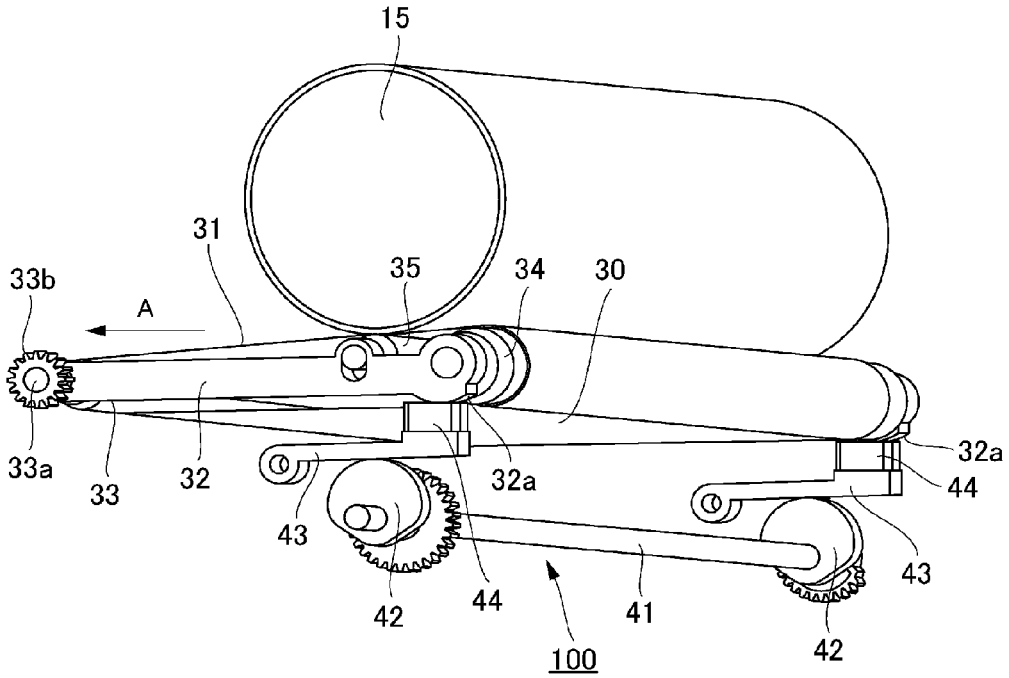
FIG. 3 is a perspective view for illustrating a contact and separation (spacing) mechanism of a belt unit with respect to a photosensitive drum in the First Embodiment.

Next, with reference to FIGS. 3 and 4, the transfer belt moving mechanism 40 will be described in detail. The transfer unit 30 is, as shown in FIG. 3, constituted by a frame 32, rollers consisting of the driving roller 33, the stretching roller 34 and the transfer roller 35 which are supported by the frame 32, and the transfer belt 31 stretched by the driving roller 33 and the stretching roller 34. On a supporting shaft 33*a* of the driving roller 33, a gear 33*b* is integrally provided, and the driving roller 33 is rotationally driven by receiving a driving force from a transfer belt driving motor (not shown) by the gear 33*b*, thus moving the transfer belt 31 in the arrow A direction. Further, the supporting shaft 33*a* of the driving roller 33 is rotatably supported by a supporting member (not shown) provided to the conveying unit 13.

Figure 4:
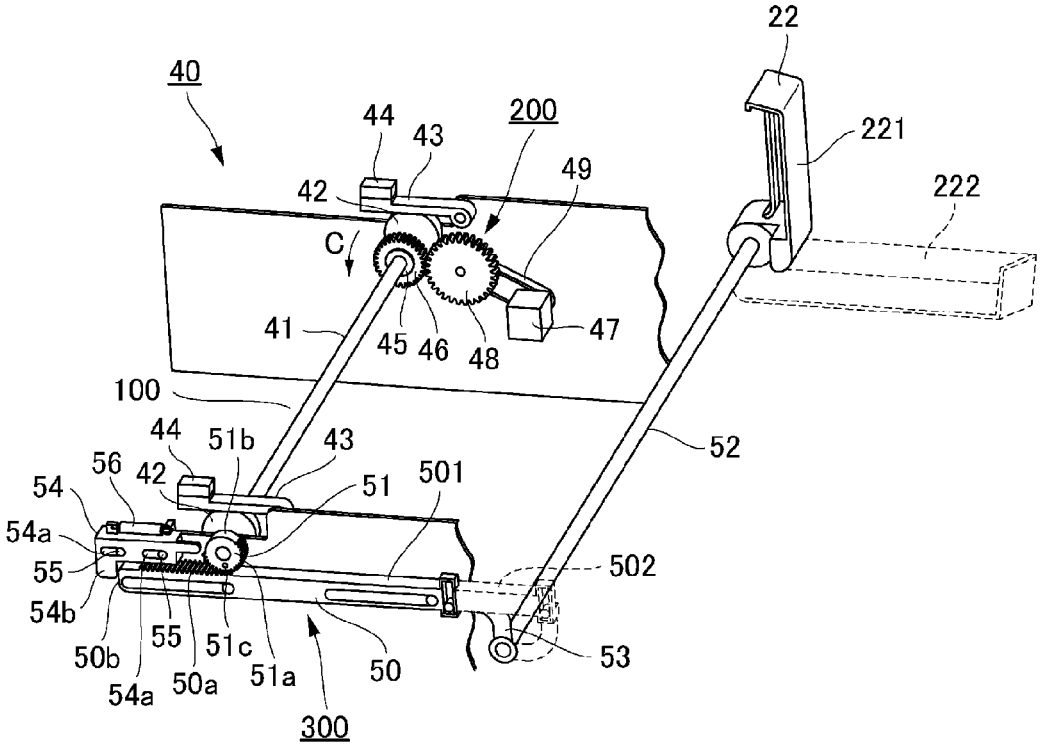
FIG. 4 is a perspective view for illustrating a structure for operating the contact and separation mechanism by a handle operation in the First Embodiment.

The transfer belt moving mechanism 40, as shown in FIG. 4, is constituted by a transfer unit urging portion 100, a motor driving portion 200 and a handle-interrelated driving portion 300.

The transfer unit urging portion 100 includes cam shaft 41 to be rotatably supported, and an urging cam 42 which is a contact and separation member rotatable integrally with the cam shaft 41. The urging cam 42 supports the supporting portion 32*a* of the frame 32 via a cam follower 43 and an urging member 44. Further, the urging cam 42 is rotationally driven to move the transfer belt 31 toward and away from the photosensitive drum 15. That is, when the urging cam 42 is rotated and its phase is moved to the top dead center, the supporting portion 32*a* is raised, so that the transfer belt 31 is contacted to the photosensitive drum 15. On the other hand, when the phase is moved to the bottom dead center, the supporting portion 32*a* is lowered, so that the transfer belt 31 is retracted (spaced) from the direction 15.

Incidentally, as the contact and separation member, in place of the urging cam 42, e.g., one such that rotation power is converted into an operation toward a contact and separation direction with respect to the photosensitive drum 15 by a gear mechanism may also be used. In short, the contact and separation member may only be required that it operates so that the transfer belt 31 is moved toward and away from the photosensitive drum 15 by being rotationally driven.

Thus, the transfer unit urging portion 100 rotates the transfer unit 30 around the driving roller 33 with the rotation of the urging cam 42, so that it can perform the contact and separation operation of the transfer belt 31 with respect to the photosensitive drum 15.

The motor driving portion 200 includes a driving motor 47 for rotationally driving the urging cam 42 and a one-way clutch 45, provided between the urging cam 42 and the driving motor 47, for transmitting unidirectional rotation. The rotation of the driving motor 47 is transmitted to the cam shaft 41 via an input gear 46 and the one-way clutch 45, so that the urging cam 42 is rotationally driven. Drive transmission between the driving motor 47 and the input gear 46 is effected via an idler gear 48 and a timing belt 49.

Here, the one-way clutch 45 acts so that rotation of the input gear 46 in an arrow C direction in FIG. 4 is transmitted to the cam shaft 41 but is not transmitted to the cam shaft 41 by idling the input gear 46 in an opposite direction to the arrow C direction. Incidentally, in place of the one-way clutch, e.g., another clutch such as an electromagnetic clutch by which power is transmitted during energy supply but is turned off during non-energy supply may also be used.

Figure 5:
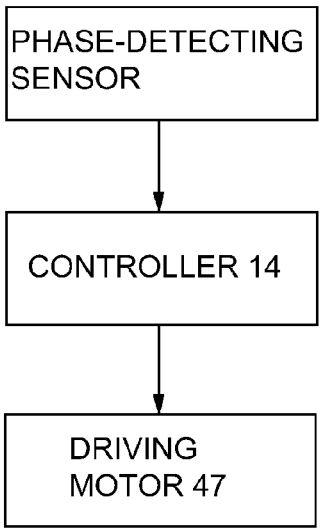
FIG. 5 is a control block diagram of a driving motor in the First Embodiment.

Further, the motor driving portion 200 includes a phase-detecting sensor (not shown) for detecting the phase of the urging cam 42. The controller 14 controls, as shown in FIG. 5, an operation of the driving motor 47 on the basis of a detection result of the phase-detecting sensor, so that the transfer belt 31 is moved toward and away from the photosensitive drum 15 depending on an image forming operation.

The handle-interrelated driving portion 300 includes a gear having partly omitted teeth 51 which is a gear rotatable together with the urging cam 42, a slide rack 50 which is a slidable member which is provided slidably with respect to the gear having partly omitted teeth 51, and the locking handle 22 as the operating portion. The gear having partly omitted teeth 51 includes a toothed portion 51*a* where there are a plurality of teeth at a portion with respect to a rotational direction and includes a non-toothed portion 51*b* where there is no tooth at another (remaining) portion with respect to the rotational direction. In this embodiment, the gear having partly omitted teeth 51 is fixed to the cam shaft 41 and is rotated together with the cam shaft 41 and the urging cam 42.

The slide rack 50 includes a rack portion 50*a* where there are a plurality of teeth as a part of the rack portion 50*a* with respect to a sliding direction. The rack portion 50*a* is slid while being engaged with the gear portion 51*a* of the gear having partly omitted teeth 51, so that the urging cam 42 is rotated via the gear having partly omitted teeth 51.

The locking handle 22 is operated by a user to move the slide rack 50 between from a locking position until a releasing position via an engaging position. That is, the slide rack 50 is connected with a handle shaft 52, which is rotated integrally with the locking handle 22, via a link member 53, and is moved between a locking position 501 and a releasing position 502 in interrelation with a rotation operation of the locking handle 22.

Here, the locking position 501 is a position where the rack portion 50*a* and the gear portion 51*a* are not engaged in a state in which the transfer belt 41 is contacted to the photosensitive drum 15. The engaging position is a position where the rack portion 50*a* and the gear portion 51*a* are engaged with each other. The releasing position 502 is a position where the rack portion 50*a* and the gear portion 51*a* are not engaged in a state in which the transfer belt 41 is spaced from the photosensitive drum 15. Accordingly, the rack portion 50*a* is provided at a position where it is engaged with the gear portion 51*a* when the slide rack 50 is moved from the locking position 501 to the releasing position 502 but is not engaged with the gear portion 51*a* when the slide rack 50 is located at the locking position 501.

As shown in (a) of FIG. 6, the gear portion 51*a* of the gear having partly omitted teeth 51 is disposed so as to be engaged with the movable rack portion 50*a* when the phase of the urging cam 42 is located in the neighborhood of the top dead center and the transfer belt 31 is contacted or close to the photosensitive drum 15. On the other hand, as shown in (b) of FIG. 6, when the urging cam 42 is moved to the bottom dead center where the transfer belt 31 is retracted from the photosensitive drum 15, also the gear having partly omitted teeth 51 is rotated integrally with the urging cam 42, so that the gear having partly omitted teeth 51 is moved to the engaging position through which the rack portion 50*a* passes.

Here, as shown in (a) of FIG. 7, in the case where the phase of the urging cam 42 is located in the neighborhood of the top dead center, when the locking handle 22 is rotated from the locking position 221 to the releasing position 222, the rack portion 50*a* moved in an arrow D direction is engaged with the gear portion 51*a*. Then, with the movement of the rack portion 50*a* in the arrow D direction, the gear having partly omitted teeth 51 is rotated in the arrow C direction.

At this time, by the action of the one-way clutch 45, idling is generated between the cam shaft 41 and the input gear 46 and therefore a rotational load of the motor driving portion 200 is not exerted on the cam shaft 41. That is, the one-way clutch 45 prevents the transmission of the rotation of the urging cam 42 to the driving motor 47 in the case where the slide rack 50 is slid from the locking position to the releasing position.

Further, arrangement and the number of teeth of the rack portion 50*a* and the gear portion 51*a* are set so that the engagement is released to eliminate the drive (driving force) transmission until the gear having partly omitted teeth 51 reaches a stop position. Incidentally, the stop position referred to herein is a position where the phase of the urging cam 42 is moved to the bottom dead center or its neighborhood so that the transfer belt 31 can be sufficiently retracted from the photosensitive drum 15.

Then, as shown in (b) of FIG. 7, the gear having partly omitted teeth 51 to which the drive transmission from the rack portion 50*a* is eliminated is rotated, integrally with the urging cam 42 subjected to a load of the transfer unit 30, to the stop position where the gear having partly omitted teeth 51 stops. At this time, when the gear having partly omitted teeth 51 does not stop but overruns, the urging cam 42 is rotated again toward the top dead center, so that there is a possibility that the transfer belt 31 is contacted again to the photosensitive drum 15.

Further, even when the urging cam 42 is not rotated to the top dead center by the overrun of the gear having partly omitted teeth 51, there is a possibility that the gear portion 51*a* enters a passing region of the rack portion 50*a* of the slide rack 50. In the case where there is the gear portion 51*a* in the passing region of the rack portion 50*a*, thereafter when the slide rack 50 is moved to the locking position by operating the locking handle 22, the rack portion 50*a* of the slide rack 50 image forms with the gear portion 51*a*.

Therefore, in the case of this embodiment, a rotation stopping mechanism 500 for preventing the gear having partly omitted teeth 51 and the urging cam 42, which are rotated in interrelation with an abrupt releasing operation of the locking handle 22, from overrunning the stop position is provided.

[Rotation Stopping Mechanism]

In the following, the rotation stopping mechanism (overrun-preventing mechanism for the gear having partly omitted teeth) 500 will be described. The rotation stopping mechanism 500 stops the rotation of the gear having partly omitted teeth 51 so that the transfer belt 31 is not contacted to the photosensitive drum 15 in the case where the slide rack 50 is slid from the engaging position to the releasing position. Particularly in this embodiment, the rotation stopping mechanism 500 is configured to stop the rotation of the gear having partly omitted teeth 51 so that the gear having partly omitted teeth 51 opposes the passing region of the rack portion 50*a* in the case where the slide rack 50 is slid from the engaging position to the releasing position.

For this purpose, the rotation stopping mechanism 500 includes a projection 51*c* as an engaging portion and a rotation stopping member 54 as a portion-to-be-engaged. The projection 51*c* is provided to the gear having partly omitted teeth 51 and is rotated together with the gear having partly omitted teeth 51. The rotation stopping member 54 is constituted so that it is engaged with the projection 51*c* at the releasing position to stop the rotation of the gear having partly omitted teeth 51 but does not stop the rotation of the gear having partly omitted teeth 51 at the locking position and the engaging position. Such a rotation stopping member 54 operates in interrelation with the slide rack 50 so that it is engaged with the projection 51*c* at the releasing position but is not engaged with the projection 51*c* at the locking position and the engaging position.

Description will be made specifically. The rotation stopping member 54 is supported, by the transfer belt moving mechanism 40, slidably relative to the gear having partly omitted teeth 51 in a direction of movement toward and away from the gear having partly omitted teeth 51. Therefore, in the rotation stopping member 54, an elongated hole 54*a* extending in the sliding direction is formed, and a supporting shaft 55 provided to the transfer belt moving mechanism 40 is inserted into the elongated hole 54*a*. As a result, the rotation stopping member 54 is slid within an engaging range between the elongated hole 54*a* and the supporting shaft 55. Further, the rotation stopping member 54 is urged by a spring 56 as an urging member in an arrow E direction which is a direction in which the rotation stopping member 54 approaches the gear having partly omitted teeth 51.

Here, shapes and positions of the rotation stopping member 54 and the projection 51*c* are set so that the rotation stopping member 54 contacts the projection 51*c* in a section from the passing of the urging cam 42 through the bottom dead center until the gear portion 51*a* does not reach the engaging position which is the passing region of the rack portion 50*a*.

For this purpose, the rotation stopping member 54 includes a contact portion 54*b* contactable with a limiting (regulating) portion 50*b* as an end of the slide rack 50. Further, as shown in (a) and (b) of FIG. 6, the contact portion 54*b* contacts the limiting portion 50*b* of the slide rack 50 located at the locking position 501, and stops at the retracted position where the rotation of the gear having partly omitted teeth 51 is not prevented. On the other hand, when the slide rack 50 is moved from the locking position 501 to the releasing position 502, the rotation stopping member 54 is moved in the arrow E direction with the movement of the slide rack 50. Thereafter, as shown in (a) of FIG. 7, the rotation stopping member 54 enters a movement region of the projection 51*c*, and moves to an operation position where an end of the elongated hole contacts the supporting shaft 55 to stop the rotation stopping member 54.

Accordingly, in the case where the gear having partly omitted teeth 51 rotated with the releasing operation of the locking handle 22 passes the stop position and continues its rotation, as shown in (b) of FIG. 7, the projection 51*c* contacts the rotation stopping member 54 moved to the operation position. As a result, it is possible to stop the rotation of the gear having partly omitted teeth 51 and the urging cam 42. In this embodiment, in a state in which the rotation of the gear having partly omitted teeth 51 is stopped, the gear having partly omitted teeth 51 is configured to oppose the passing region of the rack portion 50*a*.

Incidentally, when the slide rack 50 is located at the locking position 501, the rotation stopping member 54 is pushed by the slide rack 50 by the contact between the limiting portion 50*b* and the contact portion 54*b*, thus being retracted from the movement region of the projection 51*c*. For this reason, at the locking position, the rotation stopping member 54 does not prevent a normal operation for rotationally driving the urging cam 42 by the driving motor 47.

In the case of this embodiment, the rotation stopping mechanism 500 for stopping the rotation of the gear having partly omitted teeth as described above is provided. For this reason, when the locking handle 22 is operated so that the transfer belt 31 is spaced from the photosensitive drum 15, it is possible to prevent the gear having partly omitted teeth 51 to overrun to bring the transfer belt 31 into contact with the photosensitive drum 15 again.

Further, in the case of this embodiment, even in the case where the gear having partly omitted teeth 51 overruns the stop position, the rotation of the gear having partly omitted teeth 51 can be stopped before the gear portion 51*a* reaches the engaging position with the rack portion 50*a*. For that reason, when the locking handle 22 is rotationally moved from the releasing position 222 to the locking position 221, it is possible to prevent the contact between the overrun gear having partly omitted teeth 51 and the moving slide rack 50.

Incidentally, if only the re-contact between the transfer belt 31 and the photosensitive drum 15 by the overrun is intended to be prevented, the shapes and positions of the rotation stopping member 54 and the projection 51*c* may also be those other than the above-described constitutions. That is, before the urging cam 42 reaches the top dead center, it is only required that the rotation stopping member 54 and the projection 51*c* contact each other. Further, in this case, the gear having partly omitted teeth 51 may also be replaced with a gear having teeth on its full circumference.

Further, the digital printer 10 includes, as the belt member, the transfer belt 31 for transferring the toner image while attracting and conveying the recording material P. However, even in another embodiment in which the belt member is an intermediary transfer belt for transferring the toner image from the image bearing member such as the photosensitive drum, the present invention is applicable.

Second Embodiment

Second Embodiment of the present invention will be described with reference to FIG. 8 to FIG. 10. In the case of this embodiment, the rotation stopping mechanism for the transfer belt moving mechanism is different from that in First Embodiment described above. Other constitutions and actions are the same as those in First Embodiment and therefore in the following, redundant description and illustration are omitted or simplified and repeated reference numeral or symbols and repeated names are used as they are, and a different portion will be principally described.

A handle-interrelated driving portion 300*a* in this embodiment includes a slide rack 60 which is slidably supported and which is moved in interrelation with the rotation operation of the locking handle 22, and includes a gear having partly omitted teeth 61 rotatable integrally with the cam shaft 41. The slide rack 60 is moved in the arrow D direction with the rotation of the locking handle 22 when the releasing operation of the locking handle 22 is performed. At this time, when the transfer belt 31 is located at the contact position with the photosensitive drum 15, a rack portion 60*a* provided to the locking handle 22 engages with a gear portion 61*a* of the gear having partly omitted teeth 61 to rotate the gear having partly omitted teeth 61 in the arrow C direction. Further, the phase of the urging cam 42 rotating integrally with the gear having partly omitted teeth 61 is moved from the top dead center to the bottom dead center, so that the transfer belt 31 is retracted from the photosensitive drum 15.

Further, the handle-interrelated driving portion 300*a* includes a rotation stopping mechanism 600 and prevents the overrun of the gear having partly omitted teeth 61 and the urging cam 42. The rotation stopping mechanism 600 includes a rotation stopper 62 as a stopper portion and a stopper contact portion 60*b* as a contact portion.

The rotation stopper 62 is rotatably supported by the gear having partly omitted teeth 61. The rotation stopper 62 is rotatably supported by the cam shaft 41 to which the gear having partly omitted teeth 61 is fixed. To the rotation stopper 62, a projection (boss) 62*a* as the portion-to-be-engaged is provided. The projection 62*a* is inserted into a limiting hole 61*c* provided as the engaging portion in the gear having partly omitted teeth 61. The limiting hole 61*c* is an elongated hole along the rotational direction of the gear having partly omitted teeth 61, and limits the movement of the projection 62*a* in a region of a non-toothed portion 61*b* of the gear having partly omitted teeth 61. For this reason, the gear having partly omitted teeth 61 and the rotation stopper 62 permit movement of the projection 62*a* in the limiting hole 61*c* while relative movement thereof is limited (prevented).

The stopper contact portion 60*b* is formed on the slide rack 60 so as to satisfy the following condition. That is, the stopper contact portion 60*b* contacts, at the releasing position, a stopper portion 62*b* provided to the rotation stopper 62 to stop the rotation of the rotation stopper 62 in the same direction as the rotational direction of the gear having partly omitted teeth 61 in the case where the slide rack 60 is slid from the engaging position to the releasing position. On the other hand, the stopper contact portion 60*b* is configured not to contact the stopper 62*b* at the locking position and the engaging position. In an example of FIG. 8, the stopper contact portion 60*b* is formed so that its contact surface with the stopper 62*b* is located at a position higher than a tooth top of the rack portion 60*a* in a range ranging to the end portion of the slide rack 60 including the rack portion 60*a*. Incidentally, the stopper contact portion 60*b* is formed at a position deviated from the gear having partly omitted teeth 61 with respect to a rotational axis direction of the gear having partly omitted teeth 61, so that it contacts the stopper 62*b* but does not image form with the gear having partly omitted teeth 61.

An operation of the thus-constituted rotation stopping 600 will be described with reference to FIGS. 9 and 10. Part (a) of FIG. 9 shows a state in which the transfer belt 31 is contacted to the photosensitive drum 15, and (c) of FIG. 9 shows a state in which the transfer belt 31 is retracted from the photosensitive drum 15. Further, (b) and (d) of FIG. 9 show a transition process from the state of (a) of FIG. 9 to the state of (c) of FIG. 9 and a transition process from the state of (c) of FIG. 9 to the state of (a) of FIG. 9, respectively.

The gear having partly omitted teeth 61 is rotated in the arrow C direction integrally with the urging cam 42, rotationally driven by the driving motor 47, in order to move the transfer belt 31 toward and away from the photosensitive drum 15 depending on the image forming operation. Further, the rotation stopper 62 is rotated in the arrow C direction with the rotation of the gear having partly omitted teeth 61 while repeating the contact and separation of its projection 62*a* with respect to the inner surface of the limiting hole 61*c*. On the other hand, the slide rack 60 maintains the stop state at the locking position.

The shape of the stopper 62*b* provided to the rotation stopper 62 and the shape of the stopper contact portion 60*b* provided to the slide rack 60 are set so that the portions 62*b* and 60*b* do not contact each other in the case where the slide rack 60 is located at the locking position.

Further, in the state shown in (c) of FIG. 9 in which the transfer belt 31 is retracted from the photosensitive drum 15, the rotation stopper 62 enters the movement path (the passing region) of the rack portion 60*a* of the slide rack 60 and then stops. In such a case, the stopper contact portion 60*b* of the slide rack 60 moving in the arrow D direction interferes with the rotation stopper 62.

However, as shown in (a) of FIG. 10, the rotation stopper 62 with which the stopper contact portion 60*b* interferes is rotated in the limiting hole 60*c* in the arrow C direction to run up onto the stopper contact portion 60*b*, so that the rotation stopper 62 can avoid the interference. Then, in the case where the gear having partly omitted teeth 61 overruns the stop position when the releasing operation of the locking handle 22 is performed, as shown in (b) of FIG. 10, the stopper 62*b* contacts the stopper contact portion 60*b*. Further, the inner surface of the limiting hole 61*c* contacts the projection 62*a*, so that the rotation of the gear having partly omitted teeth 61 and the urging cam 42 is stopped. The position where the rotation of the gear having partly omitted teeth 61 and the urging cam 42 is the same as that in the First Embodiment.

Here, a relative movable range of the limiting hole 61*c* and the projection 62*a* is set so that it does not interfere with the stopper contact portion 60*b* to which the rotation stopper 62 moves and so that the gear portion 61*a* of the gear having partly omitted teeth 61 stopped during the overrun does not enter the engaging position.

In the case of this embodiment, the rotation of the overrun gear having partly omitted teeth 61 can be stopped by the contact between the stopper 62*b* and the stopper contact portion 60*b* and by the contact between the inner surface of the limiting hole 61*c* and the projection 62*a*. Further, even in the case where the slide rack 60 interferes with the rotation stopper 62 during the movement, the rotation stopper 62 runs up onto the stopper contact portion 60*b*, so that the interference with the slide rack 60 can be avoided.

Third Embodiment

Third Embodiment of the present invention will be described with reference to FIG. 11 to FIG. 13. In the case of this embodiment, the rotation stopping mechanism for the transfer belt moving mechanism is different from that in the First Embodiment described above. Other constitutions and actions are the same as those in the First Embodiment and therefore in the following, redundant description and illustration are omitted or simplified and repeated reference numeral or symbols and repeated names are used as they are, and a different portion will be principally described.

A handle-interrelated driving portion 300*b* includes a slide rack 70 which is slidably supported and which is moved in interrelation with the rotation operation of the locking handle 22, and includes a gear having partly omitted teeth 71 rotatable integrally with the cam shaft 41. The gear having partly omitted teeth 71 includes a gear portion 71*a* and a non-toothed portion 71*b*.

Further, also in this embodiment, the handle-interrelated driving portion 300*b* includes a rotation stopping mechanism 700 and prevents the overrun of the gear having partly omitted teeth 71 and the urging cam 42. The rotation stopping mechanism 700 includes a stopper portion 71 as the engaging portion and a stopper contact portion (rotation stopping portion) 70*b* as the portion-to-be-engaged.

The stopper portion 71*c* is fixed on a side surface of the gear having partly omitted teeth 71 and is rotated together with the gear having partly omitted teeth 71. Such a stopper portion 71*c* includes a toothed surface shape portion 71*e* disposed in the same phase as a starting tooth 71*d* in the upstream side with respect to the rotational direction (arrow C direction) of the gear portion 71*a* of the gear having partly omitted teeth 71. At least an end portion of the toothed surface shape portion 71*e* at the downstream surface with respect to the rotational direction is formed so that it is flush with a downstream tooth surface of the tooth 71*d* with respect to the rotational direction.

The stopper contact portion 70*b* is formed on the slide rack 70 so as to satisfy the following condition. That is, the stopper contact portion 70*b* contacts, at the releasing position, the stopper portion 71*c* to stop the rotation of the stopper portion 71*c* in the same direction as the rotational direction of the gear having partly omitted teeth 71 in the case where the slide rack 70 is slid from the engaging position to the releasing position. On the other hand, the stopper contact portion 70*b* is configured not to contact the stopper portion 71*c* at the locking position and the engaging position. In an example of FIG. 11, the stopper contact portion 70*b* is formed so that its contact surface with the stopper portion 71*c* is located at a position higher than a tooth top of the rack portion 70*a* in a range ranging to the end portion of the slide rack 70 including the rack portion 70*a*. Incidentally, the stopper contact portion 70*b* is formed at a position deviated from the gear having partly omitted teeth 71 with respect to a rotational axis direction of the gear having partly omitted teeth 71, so that it contacts the stopper portion 71*c* but does not image form with the gear having partly omitted teeth 71.

Further, the stopper contact portion 70*b* has an inclined surface 70*c* which is aligned with the tooth surface of one of racks of the rack portion 70*a* in the movement direction (arrow D direction) side during the releasing operation of the locking handle 22. In the example of FIG. 11, the inclined surface 70*c* is aligned with the tooth surface of the end of the rack portion 70*a* with respect to the movement direction during the releasing operation.

An operation of the thus-constituted rotation stopping mechanism 700 will be described with reference to FIGS. 12 and 13.

In the case where the gear having partly omitted teeth 71 overruns when the releasing operation of the locking handle 22 is performed, as shown in (a) of FIG. 12, the stopper portion 71*c* contacts the stopper contact portion 70*b*, thus stopping the rotation of the gear having partly omitted teeth 71 and the urging cam 42. The position where the rotation of the gear having partly omitted teeth 71 and the urging cam 42 is the same as that in the First Embodiment.

On the other hand, as shown in (b) of FIG. 12, the case where when the stopper portion 71*c* stops at the position such that it interferes with the stopper contact portion 70*b* moving in the arrow D direction, the releasing operation of the locking handle 22 will be described.

As shown in (a) and (b) of FIG. 13, the inclined surface 70*c* of the rack having the toothed surface shape is moved while contacting the toothed surface shape portion 71*e* of the stopper portion 71*c*, so that the rack portion 70*a* and the gear portion 71*a* are engaged with each other and thus the transfer belt 31 can be moved to the retracted position.

In the case of this embodiment, the rotation of the overrun gear having partly omitted teeth 71 can be stopped by the contact between the stopper portion 71*c* and the stopper contact portion 70*b*. Further, in the case where the stopper contact portion 70*b* interferes with the stopper portion 71*c* during the movement, of the slide rack 70, the rack portion 70*a* and the gear portion 71*a* are engaged with each other, so that the gear having partly omitted teeth 71 can be rotated.

Fourth Embodiment

Fourth Embodiment of the present invention will be described with reference to FIG. 14 to FIG. 16 in combination with FIG. 4. In the case of this embodiment, the rotation stopping mechanism for the transfer belt moving mechanism is different from that in the First Embodiment described above. Other constitutions and actions are the same as those in First Embodiment and therefore in the following, redundant description and illustration are omitted or simplified and repeated reference numeral or symbols and repeated names are used as they are, and a different portion will be principally described.

A handle-interrelated driving portion 300*c* includes a rotation stopping mechanism 800 and prevents overrun of the urging cam 42. In the case of this embodiment, the rotation stopping mechanism 800 includes a solenoid 80 as an actuator. The solenoid 80 moves a solenoid arm 81*a* as the portion-to-be-engaged to a position, in a non-energy supply state, where the solenoid arm 81*a* is engageable with the projection 42*a* as the engaging portion, and moves the solenoid arm 81*a* to a position, in an energy supply state, where the solenoid arm 81*a* is not engageable with the projection 42*a*.

The solenoid 80 is fixed on the conveying unit 13 and includes the solenoid arm 81*a* and an elastic member 81*b* for uniting the solenoid arm 81*a* in the arrow D direction. The urging cam 42 is fixed to the cam shaft 41 and includes the projection 42*a* rotatable together with the urging cam 42 and the cam shaft 41. The projection 42*a* is formed so as to project in a diameter direction of the cam shaft 41. Further, the projection 42*a* is engaged with the solenoid arm 81*a*, so that the rotation of the gear having partly omitted teeth 51 and the urging cam 42 is stopped.

The shapes and positions of the solenoid arm 81*a* and the projection 42*a* are set so that the solenoid arm 81*a* contacts the projection 42*a* in a section from the passing of the urging cam 42 through the bottom dead center until the gear portion 51*a* does not reach the engaging position with the rack portion 50*a*.

An operation of the thus-constituted rotation stopping mechanism 800 will be described with reference to FIG. 15. As shown in (a) of FIG. 15, only when the urging cam 42 is moved from the bottom dead center to the top dead center, the solenoid 80 is placed in the energy supply state. As a result, the solenoid arm 81*a* is attracted, so that the solenoid arm 81*a* is moved to a position 83 and thus is retracted from the movement range of the projection 42*a*. Then, the urging cam 42 can be freely rotated.

On the other hand, as shown in (b) of FIG. 15, when the urging cam 42 is moved to the top dead center, the energy supply to the solenoid 80 is turned off (the non-energy supply state). As a result, the solenoid arm 81*a* is moved to the position 82 again, thus entering the movement range of the projection 42*a*.

In this case, when an abrupt operation of the locking handle 22 is performed in a process in which the urging cam 42 is moved from the top dead center to the bottom dead center, the gear having partly omitted teeth 51 and the urging cam 42 which are rotated in interrelation with motion of the locking handle 22 overrun. However, the projection 42*a* contacts the solenoid arm 81*a* moved to the position 82, so that the rotation of the gear having partly omitted teeth 51 can be stopped.

A sequential operation in the case where the urging cam 42 is rotated through one-full-circumference from the bottom dead center is shown in FIG. 16. First, when the urging cam 42 is positioned at the bottom dead center (S1), energy (electric power) is supplied to the solenoid 80 (S2), so that the solenoid arm 81*a* is moved to the position 83 (S3). As a result, the rotation of the urging cam 42 is not stopped, so that the urging cam 42 can be moved to the top dead center (S4), and thus the transfer belt 31 can be contacted to the photosensitive drum 15 (S5). In this state, the energy supply to the solenoid 80 is turned off (S6). Thus, the solenoid arm 81*a* is moved to the position 82 (S7). Next, in order to space the transfer belt 31 from the photosensitive drum 15, the locking handle 22 is operated to rotate the urging cam 42, so that the urging cam 42 is moved to the bottom dead center (S8). At this time, even when the urging cam 42 overruns, the projection 42*a* contacts the solenoid arm 81*a*, so that the urging cam 42 is prevented from being further rotated.

In the case of this embodiment, by providing the rotation stopping mechanism 800, even in the case where the gear having partly omitted teeth 51 overruns the stop position, the rotation of the gear having partly omitted teeth 51 can be stopped before the gear portion 51*a* reaches the engaging position with the rack portion 50*a*. Further, by using the solenoid 80, the rotation of the urging cam 42 can be limited irrespective of a state of the machine so long as intentional energy supply to the solenoid 80 is not effected, so that it is possible to prevent the overrun of the gear having partly omitted teeth 51 caused by the abrupt handle operation or the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 044513/2012 filed Feb. 29, 2012, which is hereby incorporated by reference.

What is claimed is:

1. An image forming apparatus comprising:

an image bearing member configured to form a toner image;

a belt member configured to transfer the toner image from said image bearing member;

a cam configured to transit said belt member and said image bearing member between a contact state and a spaced state;

an operating lever configured to be movable between a first position where said belt member and said image bearing member are in the contact state and a third position where said belt member and said image bearing member are in the spaced state, wherein between the first position and the third position is a second position where said belt member and said image bearing member are switched between the contact state and the spaced state;

a first member having a first engaging portion, configured to move in interrelation with movement of said cam and to transmit a driving force of moving said operating lever to said cam when said operating lever is moved between the first position and the second position, and configured to eliminate a transmission of the driving force to said cam when said operating lever is moved between the second position and the third position;

a second member having a second engaging portion which engages with the first engaging portion, with said second engaging portion slidably movable to said first engaging portion within a predetermined range and configured to be supported by said first member; and a third member configured to regulate movement of said cam by abutting said second member when said operating lever is moved to the third position.

2. An image forming apparatus according to claim 1, further comprising a transmitting member configured to transmit the driving force to said cam, wherein said transmitting member includes a first toothed portion and a first non-toothed portion which are provided with respect to a movement direction, wherein said first member includes a second toothed portion and a second non-toothed portion which are provided with respect to a rotational direction, wherein when said operating lever is between the first position and the second position, the first toothed portion of said transmitting member and the second toothed portion of said first member are engaged with each other to transmit the driving force to said cam.

3. An image forming apparatus according to claim 1, further comprising:

a driving motor configured to drive said cam; and a controller configured to control said driving motor, wherein when said operating lever is located at the third position, said controller is capable of moving said belt member and said image bearing member from the spaced state to the contact state by driving said driving motor.

4. An image forming apparatus according to claim 1, further comprising a belt member supporting member configured to support said belt member, wherein said belt member supporting member is capable of being pulled out from a main assembly of said image forming apparatus.

5. An image forming apparatus comprising:

an image bearing member configured to form a toner image;

a belt member configured to transfer the toner image from said image bearing member;

a cam configured to transit said belt member and said image bearing member between a contact state and a spaced state;

an operating lever configured to be movable between a first position where said belt member and said image bearing member are in the contact state and a third position where said belt member and said image bearing member are in the spaced state, wherein between the first position and the third position is a second position where said belt member and said image bearing member are switched between the contact state and the spaced state;

a first member having an engaging portion, configured to move in interrelation with movement of said cam and to transmit a driving force of moving said operating lever to said cam when said operating lever is moved between the first position and the second position, and configured to eliminate a transmission of the driving force to said cam when said operating lever is moved between the second position and the third position; and a second member configured to regulate movement of said cam by abutting the engaging portion when said operating lever is moved to the third position.

6. An image forming apparatus according to claim 5, wherein an engaging portion comprises a projection provided in said first member.

7. An image forming apparatus according to claim 5, wherein an engaging portion comprises a regulating lever provided in said first member.

* * * * *